US005345914A

United States Patent [19]

Tang

[11] Patent Number: 5,345,914

[45] Date of Patent: Sep. 13, 1994

[54] ELECTRONIC FUEL INJECTION CONTROL

[75] Inventor: Dah-Lain Tang, Canton, Mich.

[73] Assignee: General Motors Corporation, Detroit, Mich.

[21] Appl. No.: 106,664

[22] Filed: Aug. 16, 1993

[51] Int. Cl.[5] ..... F02D 41/10; F02D 41/12

[52] U.S. Cl. ..... 123/478; 123/492

[58] Field of Search ..... 123/478, 480, 481, 486, 123/490, 492, 493

[56] References Cited

U.S. PATENT DOCUMENTS

| | | | |
|---|---|---|---|
| 4,221,194 | 9/1980 | Wright | 123/478 |
| 4,535,744 | 8/1985 | Matsumura | 123/481 X |
| 4,932,376 | 6/1990 | Linder et al. | 123/486 X |
| 4,955,348 | 9/1990 | Budde et al. | 123/478 |
| 4,996,965 | 3/1991 | Onari et al. | 123/492 |
| 5,031,597 | 7/1991 | Monden | 123/492 |
| 5,035,225 | 7/1991 | Mizukoshi | 123/492 X |
| 5,048,495 | 9/1991 | Onari et al. | 123/492 |
| 5,134,981 | 8/1992 | Takahashi et al. | 123/478 |

*Primary Examiner*—Willis R. Wolfe

*Attorney, Agent, or Firm*—Michael J. Bridges

[57] ABSTRACT

In engine fuel control applications in which a fuel command is issued to control at least a pair of fuel injectors, fuel command compensation is provided to stabilize fuel control from injection to injection while retaining fuel delivery accuracy. Fuel control performance over a control period is modelled, and the model stabilized through modern control techniques. Non-linear compensation is applied to reduce any residual fueling error, and both synchronous and asynchronous transient compensation are provided.

12 Claims, 4 Drawing Sheets

ELECTRONIC FUEL INJECTION CONTROL

FIELD OF THE INVENTION

This invention relates to electronic fuel injection control in internal combustion engines and, more particularly, to a method and apparatus for improving fuel delivery accuracy and stability in electronic fuel control in internal combustion engines.

BACKGROUND OF THE INVENTION

Electronically controlled port fuel injection is known. An electronic controller typically issues a commanded injection time and a commanded injection duration in the form of a timed fuel pulse to individual fuel injectors each of which is dedicated to an individual cylinder of the engine. In conventional sequential port fuel injection, each injector has a dedicated injector driver controlled by the electronic controller, and the commanded injection time and duration may be tailored to the individual needs of each of the cylinders.

In conventional alternating simultaneous double fire injection ASDF, a single fuel pulse command is issued to pairs of injectors simultaneously. In some such ASDF applications, a single injector driver electrically drives a pair of injectors and thus provides for fueling of two cylinders of the engine. Other known ASDF applications may not provide for such injector driver sharing, but may require two fuel commands to be issued simultaneously, such as in a fallback mode of fuel control wherein sequential port fuel injection is at least temporarily not available.

For a given ASDF cylinder pair, ASDF control may make only one determination of the fuel requirement for the pair in each engine cycle. Then two fuel pulse commands are issued to the pair per engine cycle in most engine operating ranges. Half of the determined fuel requirement is injected at the first injection time and the other half at the second injection time. In steady state operation wherein the demand for fuel in the engine is substantially constant, there is substantially no fuel delivery error with such conventional ASDF control. However, ASDF control can introduce significant fuel delivery error during transient maneuvers, in which the engine operating point may change rapidly without proper fuel command compensation.

For example, a commanded pulse width may be calculated just before the first of two fuel commands is to be issued to the pair of cylinders in the ASDF application. The first command properly issues half of this pulse width to the pair of injectors, but by the time the second command of the engine cycle is to be issued, the needs of the engine may have changed to the extent that the uncompensated second pulse does not adequately fuel the pair of cylinders. In a transient maneuver in which the engine speed is increasing, the cylinder will be under-fueled in this case, and in a maneuver in which the engine speed is decreasing, the cylinder will be over-fueled. Such errors in fueling can degrade engine performance and increase levels of undesirable engine exhaust gas constituents.

To eliminate such errors, analysis of the fuel requirement at each of the first and second injection times has been attempted. For example, at the time of the first injection, the total fuel requirement for the complete engine cycle is applied. Then at the time of the second injection, the fuel requirement is again determined, and the difference between that requirement and the amount of fuel already injected becomes the commanded fuel pulse width for the second injection.

While this approach may substantially eliminate fuel delivery error over an engine cycle, it decreases the stability of the fuel control, leading to fueling oscillations wherein pulse width magnitude can significantly vary from the first injection to the second within a single engine cycle. This can degrade the precision of the air/fuel control in the engine, degrading performance and increasing undesirable engine emissions. Furthermore, analysis of this error reduction approach indicates it is significantly sensitive to noise in the system, wherein unmodelled inputs to the system can lead to fueling instability and significant fuel delivery error.

To further improve engine ASDF fueling accuracy during transient maneuvers, it has been proposed to determine an enrichment factor in the form of a change in commanded fuel pulse width once per engine cycle, and apply the factor to all cylinders simultaneously. The changing fueling requirements of the engine may not be provided for in such approaches, for example when the requirement changes significantly in an engine cycle.

Accordingly, what is needed is a method and apparatus for precise and stable fueling of an engine especially during transient maneuvers, and especially in ASDF port fuel injection applications.

SUMMARY OF THE INVENTION

The present invention meets the stated need by providing an advanced control approach in which fuel delivery error may be substantially eliminated without sacrifice to system stability or to system sensitivity. While widely applicable for fuel delivery control in internal combustion engines, the present approach addresses significant shortcomings of the prior art in fuel control during transient maneuvers in ASDF fuel control applications.

More specifically, a linear representation of the fueling behavior over a control period is developed each time fuel is to be injected. The roots of the characteristic equation of the representation may then be placed through application of either classical or modern control techniques with a goal of stabilizing the representation, if necessary.

In a further aspect of the present invention, non-linear compensation is provided to any residual fueling error through application of switching surfaces to characterize the residual error, wherein compensation is selectively applied in response to the relationship between the residual error magnitude and at least one switching surface.

In yet a further aspect of the preset invention, the switching surfaces may vary with engine operating conditions, such as with determined engine fueling requirement.

In yet a further aspect of the present invention, an engine fuel enrichment factor may be calculated each time fuel is to be injected to the engine during a transient maneuver, to most precisely accommodate changing fueling requirements. The enrichment factor may be calculated synchronously, such as on an engine event basis, or asynchronously, such as on a time basis. Enrichment factors may then be calibrated so as to provide the appropriate fuel pulse width adjustment for the engine application.

Accordingly, precise fuel control is provided with appropriate attention to control stability.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
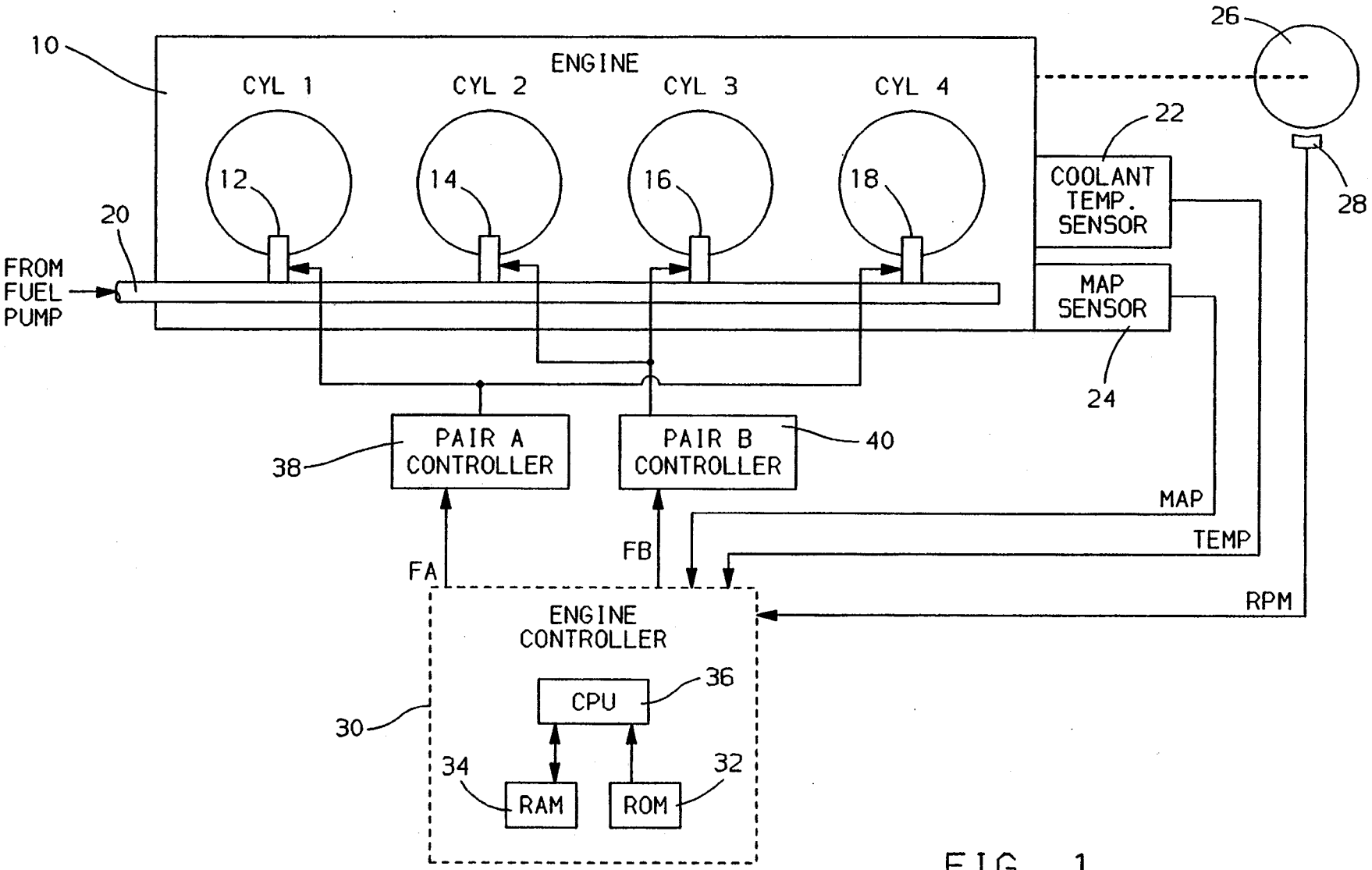
FIG. 1 is a general diagram of an internal combustion engine and engine control hardware in which fuel control in accord with the preferred embodiment of this invention is applied.

Referring to FIG. 1, an internal combustion engine having cylinders CYL1–CYL4 is provided fuel from a fuel pump (not shown) via fuel conduit 20 to conventional electrically controlled, solenoid type fuel injectors 12–18. The injectors are positioned in the engine cylinders, wherein each of the injectors 12–18 positioned in a respective individual cylinder from the set CYL1–CYL4.

A conventional engine coolant temperature sensor 22 senses engine coolant temperature and communicates signal TEMP. Engine intake manifold absolute pressure MAP is sensed by MAP sensor 24, which provides output signal MAP indicative thereof. A proximity sensor 28, such as a conventional variable reluctance sensor senses passage of teeth (not shown) on toothed wheel 26. The sensor 28 outputs a signal RPM the electrical period of which is proportional to the engine operating rate.

An engine controller 30, such as a generally available single chip microcontroller, includes such well-known constituent elements as a central processing unit CPU 36, read only memory ROM 32, and random access memory RAM 34. In accord with well-established engine control practices, the engine controller 30 receives input signals indicative of the present state of various known engine parameters, such as the described MAP, TEMP, and RPM, and determines appropriate commands, such as ignition and fuel control commands, to be issued to various conventional engine control actuators.

In the alternating simultaneous double fire ASDF fuel injection system applied to a conventional four cylinder internal combustion engine 10 in accord with the present embodiment, the engine controller issues two fuel base pulse widths, FA and FB. FA is communicated to PAIR A CONTROLLER 38 which drives the pair of fuel injectors 12 and 18 for cylinder pair A including CYL1 and CYL4, and FB is issued to PAIR B CONTROLLER 40 which drives the pair of fuel injectors 14 and 16 for cylinder pair B including CYL2 and CYL3.

In this embodiment, the single command FA controls both of pair A fuel injectors, and the single command FB controls both of pair B fuel injectors. Alternative embodiments are within the scope of this invention. For example, more than one command and more than one controller may be used to control the injector pairs, wherein the engine controller 30 issues a common fuel command to multiple controllers substantially simultaneously, and each of the controllers receiving the command from the engine controller issues a command to a corresponding fuel injector.

Returning to the present embodiment, the PAIR A CONTROLLER 38 and the PAIR B CONTROLLER 40 may include conventional injector driver hardware which converts the commands FA and FB to injector drive signals of appropriate magnitude and duration to control the corresponding injectors.

In the present embodiment, the engine controller 30 determines appropriate values for commands FA and FB through execution of a set of predetermined engine control routines. For example, the routines may include a series of instructions stored in read only memory ROM 32 which the engine controller 30 follows periodically, such as when fuel commands are to be updated. Specifically, the routine of FIGS. 2 and 3 may be executed to determine values to be output as commands FA and FB.

Figure 2A:
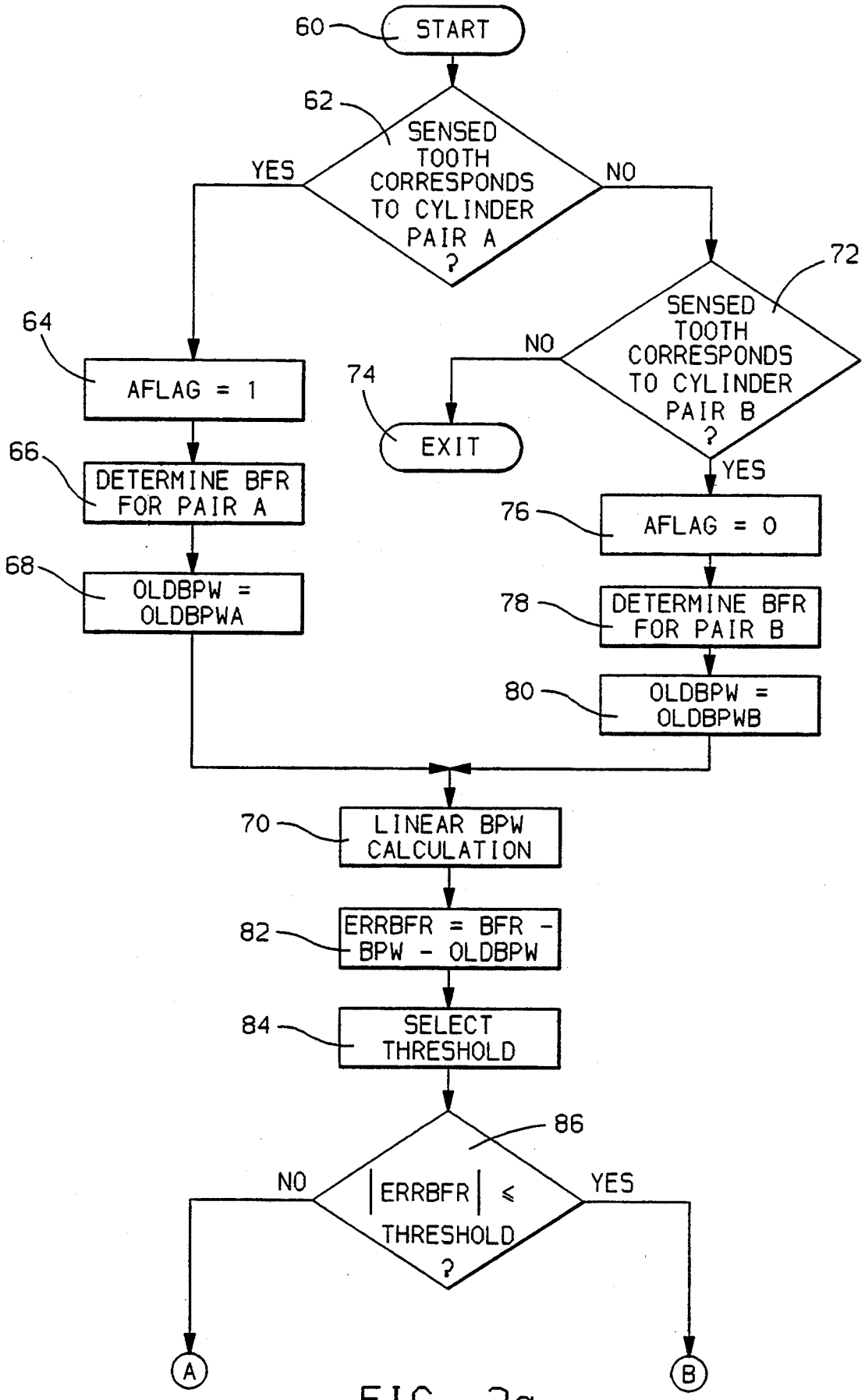
FIGS. 2*a*, 2*b* and 3 are computer flow diagrams illustrating the steps used to carry out this invention in accord with a preferred and a second embodiment.
Figure 2B:
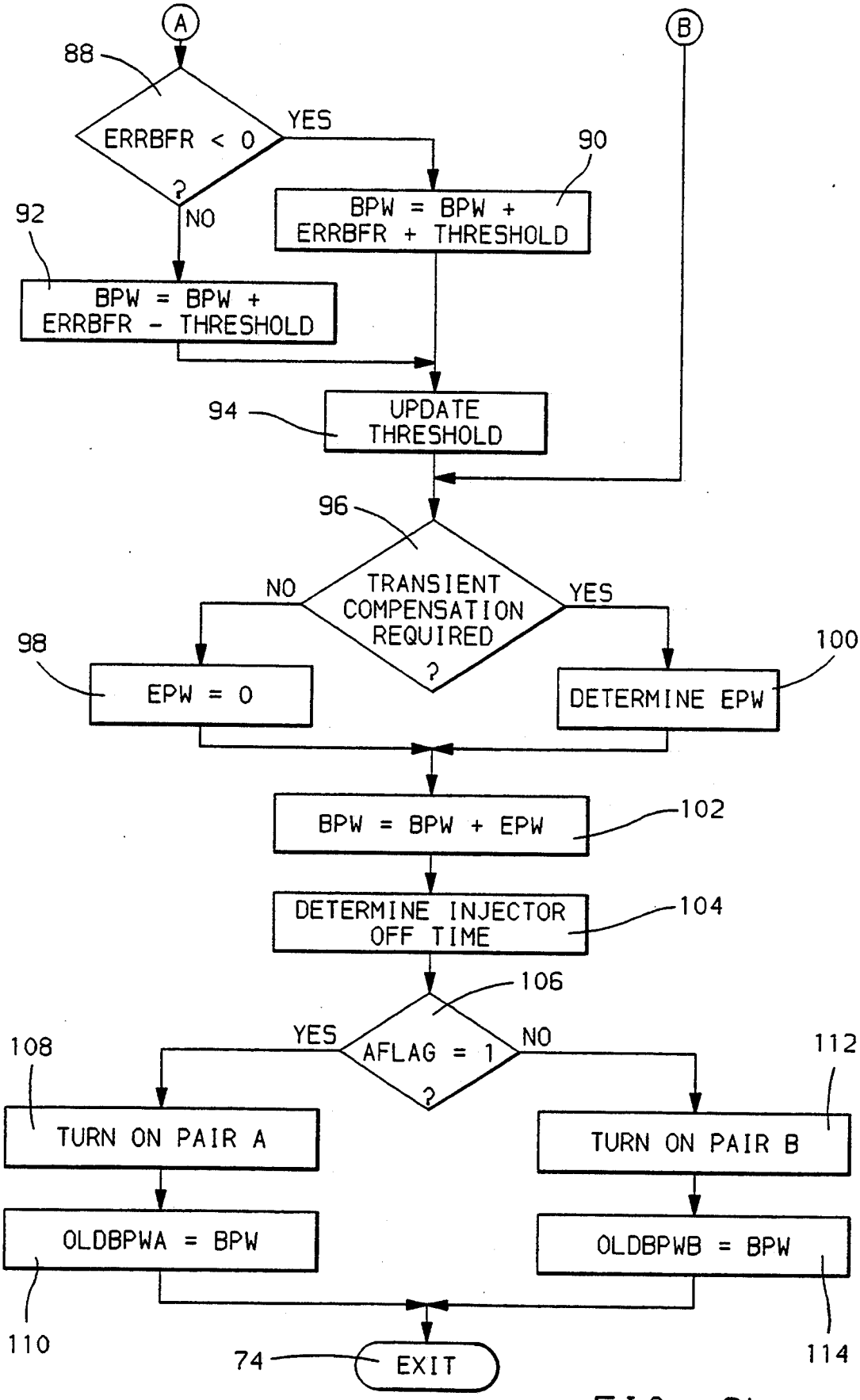

The routine of FIGS. 2*a* and 2*b* is initiated when an engine control event occurs, for example when passage of a tooth on the toothed wheel 26 (FIG. 1) is sensed, as would indicate the engine is at an angle within an engine cycle at which it would be beneficial, in accord with generally known engine control principles, to update and issue certain fuel control commands.

Upon occurrence of the tooth passage, the routine of FIGS. 2*a* and 2*b* is entered at step 60 and proceeds to step 62, to determine if the sensed tooth passage that initiated the routine of FIGS. 2*a* and 2*b* was a tooth corresponding to an engine position at which cylinder pair A should be fueled. For example, passage of a tooth corresponding to an engine position within an engine cycle at which either CYL1 or CYL4 is undergoing an intake stroke would indicate a need to fuel cylinder pair A.

If, at step 62, the sensed tooth passage corresponds to cylinder pair A, then the routine proceeds to step 64 to set a flag AFLAG to one, indicating that the fueling requirements of injector pair A are presently under consideration. Next, the routine moves to step 66, to determined, in accord with generally understood fuel control principles, a base fuel requirement BFR for cylinder pair A. For example, BFR may be referenced from a look-up table stored in ROM 32 (FIG. 1) as a function of engine speed and engine load. Engine load, which may be described as the air rate through the cylinders of the engine, may be estimated in any conventional manner, such as from a measurement of engine intake air rate, or from engine speed, MAP, and TEMP. The entries in the BFR look-up table may be determined in a conventional engine calibration as the amount of fuel at the engine speed and load needed to achieve a beneficial balance between engine performance, fuel economy and engine emissions performance.

After determining BFR for the presently active injector pair A at step 66, the routine moves to step 68, to store OLDBPWA, the most recent prior fuel command base pulse width for injector pair A, as OLDBPW, for use in subsequent steps of the present routine. Next, the routine moves to step 70, to be described.

Returning to step 62, if the present sensed tooth passage does not correspond to an engine position at which injector pair A should be actuated, the routine moves to step 72, to determine if the tooth passage corresponds to an engine position at which injector pair B should be active. If pair B should be active, the routine moves to step 76, to clear AFLAG, indicating that pair A is not active and thus by implication pair B is active presently. The routine then advances to step 78, to determine a base fueling requirement BFR for cylinder pair B, for example by referencing BFR from a look-up table stored in ROM 32 (FIG. 1), wherein the entries in the table are determined in the manner describe in the calibration of the pair A BFR lookup table as used at the described step 66. Next, the routine moves to step 80, to store OLDBPWB as OLDBPW, for use in subsequent steps of the present routine.

After executing step 68 or 80, the routine proceeds to step 70, to carry out a linear base pulse width BPW calculation in accord with the principles of this invention, to minimize the difference between required fuel and delivered fuel (fuel delivery error) without appreciably decreasing control stability. The equation used to calculate desired fuel base pulse width BPW at a kth iteration of the routine of FIGS. 2*a* and 2*b* is as follows $$BPW(k)=bo*BFR(k)+b1*BFR(k-1)+\ldots -(a1*BPW(k-1)+a2*BPW(k-2)+\ldots) \quad (1)$$

in which bi and aj are fuel delivery gains, that must satisfy the following equation to minimize fuel delivery error $$2*\Sigma ai=\Sigma bj+1.$$

The characteristic equation of equation (1) may be expressed as $$1+\Sigma(bj*Z^{-j})=0 \quad (2)$$

As is generally known in modern control theory design, through placement of the roots of equation (2) within the unit circle in the Z-domain, a stable fuel delivery control may be provided in accord with an object of the present invention.

In the present embodiment of this invention, equation (1) is simplified, and the roots of the characteristic equation placed to yield a stable control by calculating BPW as follows:

$$BPW=0.75*BFR-0.25*OLDBPW.$$

Returning to FIG. 2*a*, after determining BPW through application of the simplified linear control technique, the routine moves to step 82, to determine a fuel delivery error value ERRBFR, as the difference between the base fuel requirement BFR for the cylinder pair A over an engine cycle and both BPW and OLDBPW, the computed base pulse widths from the most recent two iterations of the present routine. In other words, ERRBFR is the difference between the desired fueling rate over an engine cycle and the amount of fuel actually commanded to a cylinder over an engine cycle.

After computing the fuel delivery error at step 82, the routine moves to steps 84–94 to compensate the commanded fueling rate as a non-linear function of ERRBFR, to more closely tailor the compensation to non-linearities in the fueling system. For example, the approach to non-linear compensation of the present embodiment includes use of switching surfaces, wherein a plurality of linear compensators may be applied as a function of a system operating parameter and its relationship to at least one threshold. Furthermore, at least one threshold value may be made adaptable as a function of the degree of prior fuel control success of the system.

Specifically, to carry out this non-linear compensation, the routine moves to step 84, to select from engine controller memory such as RAM 34 (FIG. 1) a value THRESHOLD, which defines a threshold of tolerable ERRBFR magnitude. As will be described in this embodiment, commanded fuel is adjusted so as to maintain fuel delivery error ERRBFR magnitude less than or equal to THRESHOLD. The system designer, through the use of ordinary skill in engine fuel control, may then set THRESHOLD at a value consistent with tolerable fuel deviation away from a base fuel requirement BFR. In the preferred embodiment, THRESHOLD is adaptive in that it remains fixed at a calibrated value until diagnosed to be inconsistent with system controllability, as will be described.

In an alternative embodiment, THRESHOLD may be variable. For example, it may vary according to the following $$THRESHOLD=K*BFR \quad (3)$$

in which K is a calibrated constant. In this manner, a varying tolerance for fueling error may be accommodated in the control. For example, at engine operating levels having greater base fueling requirements BFRs, fuel system performance may be less sensitive to large fueling errors than at engine operating levels having smaller BFRs, such as at an engine idle operating level. As such, THRESHOLD may increase in proportion to BFR, making the control more sensitive to the non-linear effect of ERRBFR at a determined BFR on system performance.

After determining THRESHOLD at step 84, the routine moves to step 86, to compare the magnitude of ERRBFR to THRESHOLD. If the magnitude of ERRBFR exceeds THRESHOLD, the routine moves to steps 88-94 to limit ERRBFR to THRESHOLD, consistent with the design maximum tolerable error. Specifically, the routine moves to step 88 to determine the sign of ERRBFR. If the sign of ERRBFR is negative, indicating the commanded fuel for the present engine cycle exceeds the desired base fuel requirement BFR for the present engine cycle by more than THRESHOLD, the routine proceeds to step 90, to determine a commanded fuel base pulse width BPW according to the following $$BPW=BPW+ERRBFR+THRESHOLD,$$

which provides that the difference between commanded fuel over the most recent two injections (the sum of the adjusted BPW and OLDBPW) and the BFR over the most recent two injections is limited to −THRESHOLD, as described.

Alternatively at step 88, if the sign of ERRBFR is positive, the routine moves to step 92 to determine BPW according to a second equation, as follows $$BPW=BPW+ERRBFR-THRESHOLD,$$

which provides that an updated ERRBFR, which includes BPW as adjusted at step 92, will be limited to THRESHOLD.

Through the compensation provided at the above steps 90 and 92, commanded fuel is damped to limit excursions above and below the base fueling requirement BFR to a design value THRESHOLD. Excursions more than an amount THRESHOLD below BFR over a consecutive pair of injections will be limited to −THRESHOLD through the compensation applied at step 90. Likewise, excursions more than the amount THRESHOLD below BFR over a consecutive pair of injections will be limited to +THRESHOLD through the compensation applied at step 92. Accordingly, fuel delivery oscillations, such as periodic significant variations from injection to injection are limited and minimized. Fuel delivery stability and smoothness are improved, without significant control response degradation.

After application of the non-linear compensation of steps 84–92, the routine moves to step 94, to update THRESHOLD as may be necessary in accord with the adaptive nature of the THRESHOLD of this embodiment. For example, if the magnitude of ERRBFR exceeds THRESHOLD more than a predetermined number of times over a predetermined interval, then THRESHOLD may be increased, to compensate for the apparent persistent inability of the system to precisely control fuel. In the preferred embodiment, the magnitude of THRESHOLD may be doubled in such a case. In an alternative embodiment, such as the described alternative embodiment in which THRESHOLD varies in proportion to BFR, the value of K (see equation 3) may be doubled in such a case.

Alternatively at step 94, when the magnitude of ERRBFR does not exceed THRESHOLD more than a predetermined number of times over the interval, THRESHOLD may be slowly decayed in magnitude toward zero. In the preferred embodiment, this decay may be through the following $$THRESHOLD = THRESHOLD * C,$$

in which C may be a constant magnitude, less than but close in magnitude to unity. In an alternative embodiment, such as the described alternative embodiment in which THRESHOLD is varies in proportion to BFR, THRESHOLD may be decayed by decaying the magnitude of K (see equation 3), such as through the following $$K = K * C2$$

in which C2 may be a constant less than but close in magnitude to unity.

After making any update to THRESHOLD in accord with the adaptive THRESHOLD of the present embodiment, the routine moves to step 96, to determine if additional transient fuel command compensation in accord with this embodiment is required. It is generally known to adjust engine fueling rate in response to transient conditions, such as may be sensed by the rate of change in BFR exceeding a predetermined rate of change.

For example, a commanded fuel injector pulse width duration may be extended under a transient condition having an increasing fuel requirement, and may be retracted under a transient condition having a decreasing fuel requirement. In the preferred embodiment of the invention, such adjustments are made synchronously, on an injector by injector basis. In an alternative embodiment, as will be described in FIG. 3, such adjustments are made asynchronously, on an injector by injector basis.

Returning to FIG. 2b, in the preferred embodiment an enrichment pulse width EPW is determined at step 100 when transient compensation is determined to be required at step 96, for example when the time rate of change in BFR exceeds a predetermined time rate of change. In accord with generally known transient fueling enrichment practice, EPW is the amount by which the BPW, already determined in the present routine, is to be adjusted in response to the magnitude of the sensed transient condition. EPW may be referenced from a conventional lookup table in engine controller 30 (FIG. 1) read only memory ROM 32, from known lookup parameters, such as time rate of change in BFR, engine speed RPM, and manifold absolute pressure MAP. EPW should be calibrated through known calibration procedures according to the degree of adjustment in pulse width necessary to provide acceptable engine performance, fuel economy, and emissions under the magnitude of the sensed transient condition. EPW may be negative under transient conditions having a decreasing BFR, and may be ositve otherwise. Returning to step 96 of the routine of FIGS. 2a and 2b, if transient compensation is required, the routine determines EPW at step 100. If no such compensation is determined to be necessary at step 96, EPW is cleared at step 98.

After assigning a value to EPW at either of steps 98 or 100, the routine moves to step 102, to adjust the previously determined base pulse width BPW by the determined EPW. The routine then advances to step 104, to determine a fuel injector off time, which may generally be the present time plus the time represented by the determined BPW. This off time may be stored as a time to execute a time based engine controller interrupt, which interrupt is configured to automatically end the injection period for the active injector pair. Such interrupt control of controller output signals is generally known in the electronic engine control art.

The routine then proceeds to step 106, to determine which of the pair A or pair B injectors of the present embodiment are active, as indicated by the value stored in RAM variable AFLAG. If AFLAG is set to one, injector pair A is active, and the routine moves to step 108 to activate injector pair A, by setting output signal FA high, for communication to PAIR A CONTROLLER 38 (FIG. 1). In accord with generally understood fuel injection practice, PAIR A CONTROLLER will issue a drive command to injector pair A, including injectors 12 and 18, sufficient to open injector pair A to allow the pressurized fuel from fuel conduit 20 to pass through the injectors to their respective cylinders CYL1 and CYL4 while the signal FA remains high. In this embodiment, an injection of pair A injectors is initiated at step 108 by setting output signal FA (FIG. 1) high. In the event AFLAG was low at step 106, indicating pair B injectors 14 and 16 (FIG. 1) are active, output signal FB would be driven high at step 112 of the present routine. In either case, the injector off time determined at sep 104 will be the time the high one of signals FA and FB will be returned low, ending the period of time the associated injector pair injects to the corresponding cylinder pair. This injection termination may occur through execution of an interrupt in engine controller 30 (FIG. 1) which is set to occur at the determined injector off time, with instruction to automatically return either of output signals FA or FB low, as described generally at step 104.

After turning on injector pair A at step 108, the routine moves to step 110 to store the present base pulse width BPW used to determine the injector pair A on time, as OLDBPWA, for use in the next iteration of the routine of FIGS. *2a* and *2b* in which injector pair A is active. The routine is then exited at step 74, for example to resume any processes that were interrupted by the start of the routine of FIGS. *2a* and *2b*.

Alternatively, after turning on injector pair B at step 112, the routine moves to step 114 to store the present base pulse width BPW used to determine the injector pair B on time, as OLDBPWB, for use in the next iteration of the routine of FIGS. *2a* and *2b* in which injector pair B is active. The routine is then exited at step 74, in the manner described.

Figure 3:
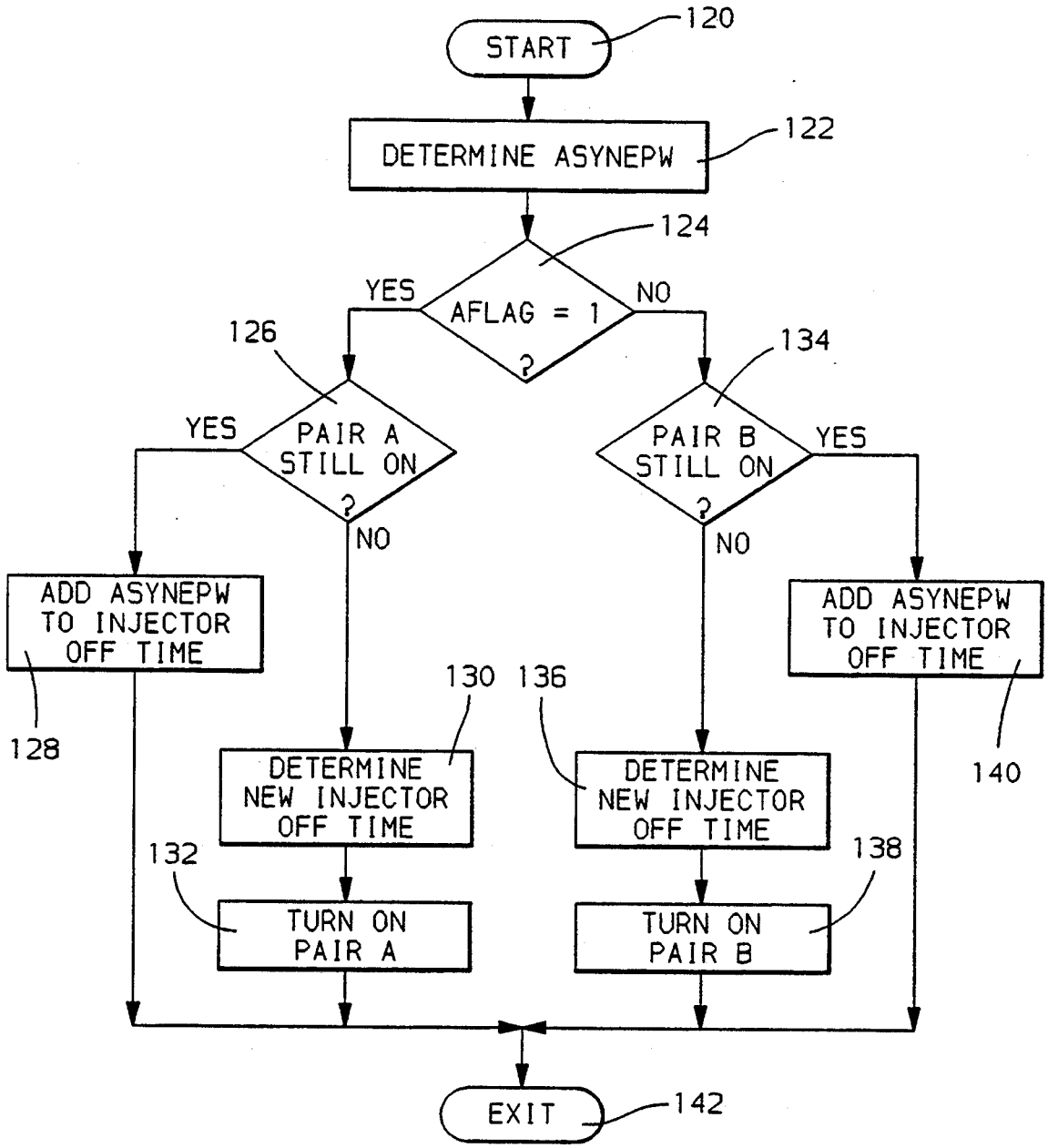

FIG. 3 describes an alternative transient compensation approach in which enrichment or enleanment in response to an engine transient condition is applied asynchronously, on a fixed time base and not on an event base, such as the engine position event base on which the synchronous transient fuel compensation of steps 96–102 of the routine of FIGS. *2a* and *2b* was applied. Accordingly, in an alternative embodiment of the present invention, steps 96–102 of the routine of FIG. *2b* would be deleted and transient fuel compensation would provided through application of the routine of FIG. 3.

FIG. 3 is executed in the following manner. When the engine controller 30 (FIG. 1) is operating to control fuel to engine 10, the routine of FIG. 3 will be periodically executed, such as approximately every 6.25 milliseconds, starting at step 120. The routine moves from step 120 to step 122, to determine an enrichment pulse width ASYNEPW, which may take on a negative value in a transient condition having a decreasing fuel requirement, and may take on a positive value in transient condition having an increasing fuel requirement.

ASYNEPW may be considered to represent negative or positive pulse duration, and may have units of time. ASYNEPW will be combined with the BPW determined in FIGS. *2a* and *2b* to form a fuel command adjusted for the transient condition, as in the case of the synchronous transient compensation pulse EPW of the preferred embodiment.

As in the determination of EPW at step 100 of FIG. *2b* in the preferred embodiment, the determination of ASYNEPW is made in accord with generally known transient fueling enrichment practice. Specifically, ASYNEPW is the amount by which BPW is to be adjusted in response to the magnitude of the sensed transient condition.

ASYNEPW may be referenced from a conventional lookup table in engine controller 30 (FIG. 1) read only memory ROM 32, from known lookup parameters, such as time rate of change in BFR, engine speed RPM, manifold absolute pressure MAP, and engine coolant temperature TEMP. ASYNEPW should be calibrated through known calibration procedures according to the degree of adjustment in pulse width BPW necessary to provide acceptable engine performance, fuel economy, and emissions under the magnitude of the sensed transient condition. ASYNEPW may be negative under transient conditions having a decreasing BFR, and may be positive otherwise, as described.

After determining ASYNEPW at step 122, the routine moves to step 124, to determine which injector pair was most recently active. It is the most recent active injector pair that will receive the compensation of the routine of FIG. 3. If, at step 124, AFLAG is set to one indicating pair A was most recently active, the routine moves to step 126 to determine if pair A is still injecting, that is if signal FA (FIG. 1) is still high. This may be determined by analyzing the engine controller output port (not shown) through which FA is output, or by analyzing the injector off time determined at step 104 of the routine of FIG. *2b* to ascertain if it exceeds the present time. If at step 126, pair A is still injecting, the determined ASTNEPW will simply be added to the injector off time, to either shorten it or lengthen it, as needed to compensate for the determined transient condition. The adjusted injector off time will then dictate the time of the end of the injection to injector pair A. Alternatively at step 126, if pair A is not still on, the routine moves to step 130, to determine a new injector off time from the present time to permit injector pair A to meter fuel for a period of time consistent with the determined ASYNEPW. This off time may be stored as a time to execute an engine controller interrupt configured to automatically end the injection period for injector pair A, such as by returning output signal FA (FIG. 1) low.

After determining off time, the routine moves to sep 132 to turn on injector pair A, such as by setting signal FA (FIG. 1) high. The signal will return low at the determined off time, as described.

After either of steps 128 or 132, the routine of FIG. 3 exits via step 142, to resume any engine controller operations that were interrupted to allow execution of the routine of FIG. 3.

Returning to step 124, if AFLAG is not set to one, indicating injector pair B was most recently active, the routine moves to steps 134–140, to provide asynchronous transient fuel compensation for injector pair B. Specifically, the routine moves to step 134 to determined if pair B is still injecting, in the manner described at step 126 of FIG. 3. If pair B is still injecting, the routine moves to step 140, to add the determined ASYNEPW to the injector off time, to lengthen it or retract it, according to the sign of ASYNEPW. The routine then exits via step 134, in the manner described.

Alternatively, at step 134, if pair B is not still injecting, the routine moves to step 136, to determine a new injector off time as the injection start time plus the time represented by the ASYNEPW determined at step 122. This off time may be used to trigger an interrupt configured to automatically end the injection duration at injector pair B, in the manner outlined in FIGS. *2a* and *2b* of the preferred embodiment.

After determining an injector off time at step 136, the routine moves to step 138 to start the injection of injector pair B, such as by setting FB (FIG. 1) to a high level, as described in the preferred embodiment. The routine then exits via step 142 in the manner described.

The preferred and alternative embodiments for the purpose of explaining this invention are not to be taken as limiting or restricting the invention since many modifications may be made through the exercise of skill in the art without departing from the invention.

The embodiments of the invention in which a property or privilege is claimed are described as follows:

1. A method of controlling a magnitude of a fuel command periodically issued to control at least one pair of fuel injectors in an internal combustion engine, wherein a base fueling requirement is determined each time the fuel command is to be issued to the pair of injectors, comprising the steps of:

sensing an engine operating level;

determining a present base fuel requirement over an engine cycle in accord with the sensed engine operating level;

developing a fueling performance model describing the manner in which past base fuel requirements have been provided for over a predetermined control period, as a predetermined function of base fuel requirements and fuel commands issued over the control period;

determining a present fuel command in accord with the developed model; and issuing the present fuel command to control at least the one pair of fuel injectors.

2. The method of claim 1, wherein the step of developing a fueling performance model develops the model as a sum of weighted base fuel requirements determined over the control period and weighted fuel commands issued over the control period.

3. The method of claim 2, wherein the weights by which the base fueling requirements and the fuel commands are weighted are selected by (a) determining a characteristic equation of the developed model, (b) determining the roots of the characteristic equation, (c) selecting the weights so as to place the roots of the characteristic equation within predetermined regions.

4. The method of claim 3, wherein the predetermined regions are within the unit circle in the Z domain.

5. The method of claim 1, further comprising the step of:

measuring engine operating parameters indicative of an engine transient maneuver magnitude;

determining a transient compensation value as a predetermined function of the measured engine operating parameters; and adjusting the present fuel command in accord with the determined transient compensation value.

6. A method of controlling a magnitude of a fuel command periodically issued to control at least one pair of fuel injectors in an internal combustion engine, wherein a base fueling requirement is determined each time the fuel command is to be issued to the pair of injectors, comprising the steps of:

sensing an engine operating level;

determining a present base fuel requirement over an engine cycle in accord with the sensed engine operating level;

developing a fueling performance model describing the manner in which past base fuel requirements have been provided for over a predetermined control period, as a predetermined function of base fuel requirements and fuel commands issued over the control period;

determining a present fuel command in accord with the developed model;

calculating a fuel delivery error as the difference between the present base fuel requirement for the engine cycle and the sum of the present fuel command and a past fuel command;

comparing the magnitude of the fuel delivery error to an error threshold value;

adjusting the present fuel command in direction to reduce the magnitude of the fuel delivery error to the error threshold value when the magnitude of the fuel delivery error exceeds the error threshold value; and issuing the adjusted present fuel command to control at least the one pair of fuel injectors.

7. The method of claim 6, wherein the error threshold value varies as a predetermined function of a predetermined engine operating parameter.

8. The method of claim 6, wherein the error threshold value varies in proportion to the present base fuel requirement.

9. The method of claim 6, wherein the step of developing a fueling performance model develops the model as a sum of weighted base fuel requirements determined over the control period and weighted fuel commands issued over the control period.

10. The method of claim 9, wherein the weights by which the base fueling requirements and the fuel commands are weighted are selected by (a) determining a characteristic equation of the developed model, (b) determining the roots of the characteristic equation, (c) selecting the weights so as to place the roots of the characteristic equation within predetermined regions.

11. The method of claim 10, wherein the predetermined regions are within the unit circle in the Z domain.

12. The method of claim 6, further comprising the step of:

measuring engine operating parameters indicative of an engine transient maneuver magnitude;

determining a transient compensation value as a predetermined function of the measured engine operating parameters; and adjusting the present fuel command in accord with the determined transient compensation value.

* * * * *